United States Patent [19]

Takeuchi et al.

[11] 4,002,305

[45] Jan. 11, 1977

[54] DEVICE FOR FORMING A TAIL WIND AROUND A BOBBIN HELD BY A TAKE-UP MECHANISM OF A RINGLESS SPINNING MACHINE

[75] Inventors: Tatsuo Takeuchi; Kozo Motobayashi, both of Aichi; Kazuo Kamiya, Nishio, all of Japan

[73] Assignees: Kabushiki Kaisha Toyoda Jidoshokki Seisakusho, Aichi; Daiwa Boseki Kabushiki Kaisha, Osaka, both of Japan

[22] Filed: June 25, 1975

[21] Appl. No.: 590,042

[30] Foreign Application Priority Data

June 26, 1974 Japan ..... 49-75573

[52] U.S. Cl. ..... 242/18 PW

[51] Int. Cl.[2] ..... B65H 54/34; D01H 1/12

[58] Field of Search ..... 57/34 R, 58.89, 58.95, 57/34 TT; 242/18 R, 18 DD, 18 PW, 18 EW

[56] References Cited

UNITED STATES PATENTS

| | | | |
|---|---|---|---|
| 2,631,787 | 3/1953 | Tata | 242/18 PW |
| 2,638,279 | 5/1953 | Winslow | 242/18 PW |
| 3,065,921 | 11/1962 | Furst | 248/18 PW |
| 3,251,560 | 5/1966 | Macedo | 242/18 PW |
| 3,282,516 | 11/1966 | Porter | 242/18 PW |
| 3,595,490 | 7/1971 | Schnetzer et al. | 242/18 PW |
| 3,695,017 | 10/1972 | Hori et al. | 57/34 R |
| 3,819,123 | 6/1974 | Luz | 242/18 PW |
| 3,838,828 | 10/1974 | Hautemont | 242/18 DD |

*Primary Examiner*—John Petrakes
*Attorney, Agent, or Firm*—Burgess Ryan and Wayne

[57] ABSTRACT

A device for forming a transfer tail wind around a bobbin held by a take-up mechanism of a ringless spinning machine such as an open-end spinning machine. The tail wind forming device comprises an auxiliary yarn guide disposed at a position along a yarn passage formed between the delivery roller means and a traverse motion mechanism of the take-up mechanism. The auxiliary yarn guide is provided with a groove for restricting the above-mentioned yarn passage to a position corresponding to an end portion of the bobbin, where the yarn is free from the traverse motion mechanism, when the transfer tail wind is being formed on the bobbin.

6 Claims, 10 Drawing Figures

DEVICE FOR FORMING A TAIL WIND AROUND A BOBBIN HELD BY A TAKE-UP MECHANISM OF A RINGLESS SPINNING MACHINE

SUMMARY OF THE INVENTION

The present invention relates to a device for forming a transfer tail wind around a bobbin held by a take-up mechanism of a ringless spinning machine such as an open-end spinning machine.

In the spinning operation utilizing a ringless spinning machine, since the leading end of a yarn of each yarn package formed on a cylindrical tube, that is, a bobbin, is wound on the bobbin and, therefore, this leading end of yarn is covered with the upper layers of yarn of the yarn package produced by the ringless spinning machine, when it is required to connect the above-mentioned leading end of yarn of a fresh yarn package with a transfer tail end of a following fresh yarn package so as to carry out the yarn supply operation continuously in the successive process, such as a warping process of a weaving factory, it is very difficult to find and pick-up the above-mentioned leading end of yarn on the bobbin of the fresh yarn package and, consequently, the working efficiency of the above-mentioned successive operation is very much lowered.

The principal object of the present invention is to provide a device for forming a tail wind by a leading end of yarn supplied from a delivery mechanism of a unit of a ringless spinning machine around a bobbin held by a take-up mechanism of the unit at a position outside a normal winding portion thereof before starting the normal operation, so that the tail wind of each yarn package produced by the ringless spinning machine can be easily found and pickd up and, consequently, the above-mentioned problem found with the yarn package produced by the conventional take-up mechanism of the ringless spinning machine can be perfectly eliminated.

To attain the above-mentioned object of the present invention, the device for forming a transfer tail wind around a bobbin held by a take-up mechanism of each unit of a ringless spinning machine comprises an auxiliary yarn guide disposed at a position adjacently upstream of a traverse mechanism of the unit along a yarn passage formed between a delivery roller means of the unit and the traverse mechanism. The auxiliary yarn guide comprises a supporting bracket and a guide plate turnably supported by the supporting bracket, the guide plate being provided with a yarn guide edge composed of a groove and a guide edge portion extending to the groove portion. The guide edge portion is provided with a smooth slope inclined toward the groove portion and, consequently, if a yarn delivered from the delivery roller means toward the traverse mechanism is urged to the guide edge portion, while the guide plate is held parallel to the direction of the motion of the traverse mechanism, the yarn is moved along the guide edge portion and displaced into the groove. Therefore, the passage of the yarn delivered from the delivery roller means is defined by the groove of the guide plate. The auxiliary guide is positioned in such a way that the groove of the guide plate directs the yarn to a particular position outside the normal winding portion of a bobbin held by the take-up mechanism of each unit when the guide plate is held at the above-mentioned parallel condition to the direction of the traverse motion. When the yarn passage is defined by the groove of the guide plate, the yarn escapes from the motion of the traverse mechanism and, therefore, the yarn delivered from the delivery roller means is wound on the bobbin at the above-mentioned particular position of the bobbin so that a tail wind can be formed.

DETAILED EXPLANATION OF THE INVENTION

For the sake of easy understanding of the tail wind forming device according to the present invention, the method for producing a yarn package by the take-up mechanism of the conventional ringless spinning machine is first explained.

Figure 1:
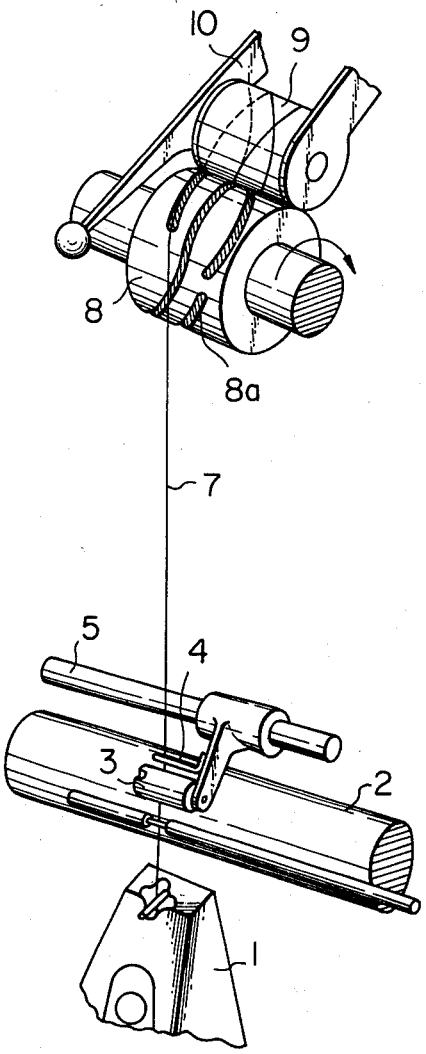
FIG. 1 is a schematic perspective view of a take-up mechanism and a delivery roller means of a unit of a conventional ringless spinning machine.

In a unit of a conventional ringless spinning machine shown in FIG. 1, a yarn 7 produced by a spinning unit 1 is carried to a split drum 8 of a traverse mechanism by way of a delivery roller means comprising a delivery roller 2 and a top roller 3 turnably mounted on the delivery roller 2, and a yarn guide 4. Then the yarn 7 is wound on a bobbin 9, which is rotatably held by a supporting cradle 10 and is in contact with the split drum 8. The split drum 8 is provided with a yarn guide groove 8a which guides the yarn 7 so as to create a quick traverse motion thereof. Consequently, a cross wound yarn package is formed on the bobbin 9. In the above-mentioned take-up mechanism, a tail wind is formed by utilizing a yarn guide for forming a pig tail on the yarn package. However, according to our experience, it is impossible to always assure the engagement of the yarn 7 with such yarn guide.

Figure 2:
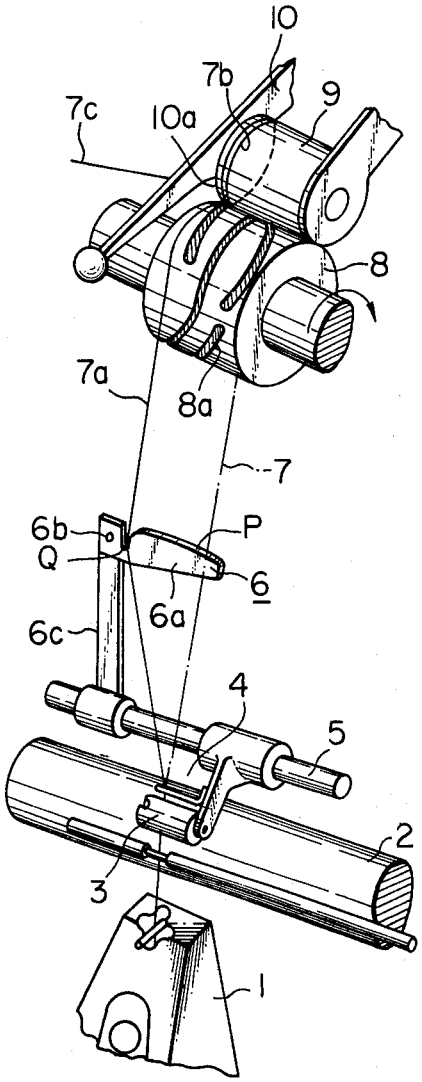
FIG. 2 is a schematic perspective view of a take-up mechanism and a delivery roller means of a unit of a conventional ringless spinning machine provided with a tail wind forming device according to the present invention.
Figure 3:
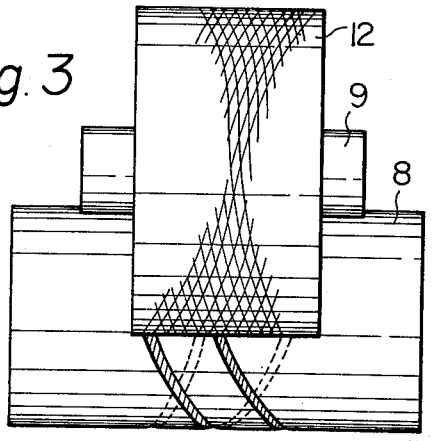
FIG. 3 is a schematic front view of the auxiliary yarn guide of the tail wind forming device shown in FIG. 2.
Figure 4:
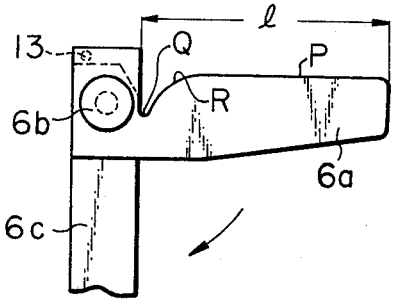
FIG. 4 is also a schematic front view of the auxiliary yarn guide shown in FIG. 3, at its standby position.
Figure 4:
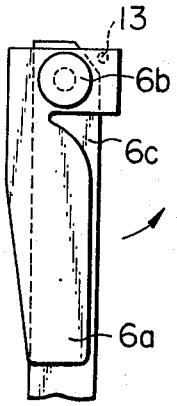
Figure 5:
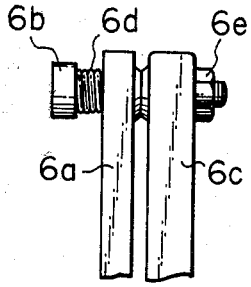
FIG. 5 is a schematic side view of the auxiliary yarn guide shown in FIG. 4.
Figure 6:
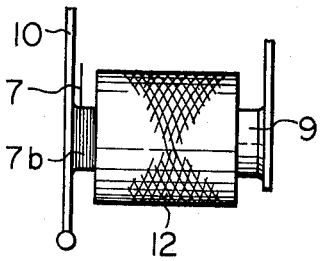
FIG. 6 is a schematic front view of a part of the take-up mechanism shown in FIG. 2, after forming a tail wind on a bobbin at a position outside the yarn package.

To solve the above-mentioned Problem, in the transfer tail wind forming device according to the present invention, as shown in FIG. 2, an auxiliary yarn guide 6 is disposed at a position along the yarn passage between the yarn guide 4 and the split drum 8. The auxiliary yarn guide 6 comprises a supporting bracket **6*c*, rigidly mounted on a supporting shaft 5 which supports the top roller 3, and a guide plate 6*a* turnably mounted to a top free portion of the supporting bracket 6*c* by a pin shaft 6*b* as shown in FIGS. 3 and 4. To assure the relative angular position of the guide plate 6*a*** to the supporting bracket 6*c*, a compression spring 6*d* is mounted on the pin shaft 6*b* at a position between a head of the pin shaft 6*b* and the guide plate 6*a*, as shown in FIG. 5, so that the guide plate 6*a* is always urged to the supporting bracket 6*c*, and the free turning of the guide plate 6*a* about the pin shaft 6*b* is prevented. The pin shaft 6*b* is thread engaged into the supporting bracket 6*c* and fastened by a fastening nut 6*e*. The guide plate 6*a* is manually turned to a horizontal position (FIG. 3) when it is required to form a transfer tail wind on a bobbin 9 and, after that, the guide plate 6*a* is manually turned to a vertical position (FIG. 4) from the above-mentioned horizontal position. The guide plate 6*a* is maintained at the above-mentioned vertical position during the normal winding operation for forming a yarn package 12 (FIG. 3). A stopper 13 is rigidly mounted to the supporting bracket 6*c* so as to stop the guide plate 6*a* at the correct horizontal position when the guide plate 6*a* is manually turned from the vertical position (FIG. 4) toward the horizontal position (FIG. 3). The guide plate 6*a* is provided with a substantially straight edge portion P, a grooved portion Q formed at a position close to the pin shaft 6*b* and a curved edge portion R connecting the straight edge portion P to the grooved portion Q, as shown in FIG. 3.

The operation of the transfer tail wind forming device mentioned above is hereinafter explained in detail. Referring to FIG. 2, when the normal winding operation to form yarn package is carried out, the guide plate 6*a* of the auxiliary yarn guide 6 is positioned at its vertical position (FIG. 4), and the yarn 7 delivered from the rollers 2 and 3 via the yarn guide 4 passes through the yarn passage represented by a broken line shown in FIG. 2 so as to move with a traverse motion induced by the action of the split drum 8. Just before doffing a full size yarn package 12 from the supporting cradle 10, the guide plate 6*a* is manually turned to the horizontal position (FIG. 3) from its standby position (FIG. 4). In this condition, the guide plate 6*a* is in a position in front of the above-mentioned yarn passage represented by a broken-line in FIG. 2. The above-mentioned yarn passage is manually displaced to a position in front of the guide plate 6*a*, the supporting cradle 10 is turned away from the split drum 8 and the full size yarn package 12 is manually doffed from the supporting cradle 10 soon after the above-mentioned displacement of the yarn passage. A fresh bobbin 9 is inserted into the supporting cradle 10 and the cradle 10 is turned toward the split drum 8 so as to urge the fresh bobbin 9 to the drum 8.

During the above-mentioned turning motion of the cradle 10 toward the split drum 8, since the yarn 7 is caught by the guide groove 8*a* of the split drum 8, the yarn 7 commences its traverse motion. However, when the yarn 7 is transversally displaced toward the left hand direction in FIG. 2, the yarn 7 slides along the straight guide edge P of the guide plate 6*a* toward the grooved portion Q and, consequently, the yarn 7 is caught by the groove portion Q. In this condition, the yarn 7 leaves the groove 8*a* of the split drum 8. Since the groove portion Q is sharply formed with the curved edge portion R is also formed with a very steep incline and, further, the yarn 7 is being carried in a stretched condition, there is no possibility of the yarn 7 escaping from the groove Q of the guide plate 6*a* unless the yarn 7 is picked up manually. Consequently the yarn 7 is carried to the split drum 8 along a yarn passage 7*a* show in FIG. 2 via the groove portion Q of the guide plate 6*a*, so that the yarn 7 is wound on the bobbin 9 as a position outside of the normal winding position thereof. The tail end 7*c* of the doffed yarn package is wound on the bobbin 9 in the normal winding direction and cut by being hooked to an edge portion 10*a* of the supporting cradle 10 by manual operation. The cut end portion of the yarn 7 created by the above-mentioned cutting operation is wound on the bobbin 9 in the direction reverse to the normal winding so that a transfer tail wind is formed on an edge portion of the bobbin 9. Thereafter, the guide plate 6*a* is turned to its standby position (FIG. 4), the yarn 7 is caught by the groove 8*a* of the split drum 8, and the normal traverse motion then is imparted to the yarn 7. The guide plate 6*a* is positioned at the standby position (FIG. 4) until the next doffing operation is carried out. In the above-mentioned embodiment, the size of the guide plate 6*a* must be selected in such a condition that the free end of the straight edge portion P of the guide plate 6*a* is positioned at a position slightly outside of a terminal of the stroke of the traverse motion of the yarn 7 when the guide plate 6*a* is turned to the horizontal position (FIG. 3) thereof; the grooved portion Q is positioned at a position slightly outside the other terminal of the stroke of the traverse motion of the yarn 7 when the guide plate 6*a* is turned to the above-mentioned horizontal position, and; the length of the yarn guide passage formed by the straight edge portion P, the curved portion R and the grooved portion Q is large enough to prevent an unexpected escape of the yarn 7 from the guide plate 6*a* due to the traverse motion of the yarn 7 when the guide plate 6*a* is positioned at its horizontal position. The reference numeral 7*b* represents an end of the transfer tail wind formed on a bobbin 9 created by the device shown in FIG. 2.

Figure 7:
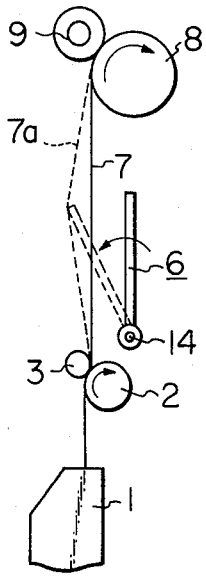
FIGS. 7 and 8 are schematic side views of a unit of the take-up mechanism and delivery roller means of a unit of a ringless spinning machine provided with modified embodiments of the tail wind forming device according to the present invention, respectively.
Figure 9:
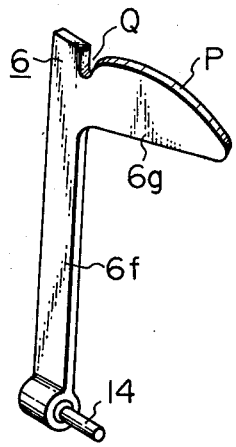
FIGS. 9 and 10 are perspective views of the auxiliary yarn guides utilized of the tail wind forming devices shown in FIG. 7 and 8, respectively.

In the modified embodiment of the transfer tail wind forming device shown in FIGS. 7 and 9, the auxiliary yarn guide 6 is turnably mounted on a horizontal supporting shaft 14 in such a condition that the yarn passage of the yarn 7 is formed between the rollers 2, 3, and the split drum 8 is displaced to the yarn passage 7*a* from the normal yarn passage represented by a solid line in FIG. 7 by the pushing action of the auxiliary yarn guide 6 when it is required to form the transfer tail wind on the bobbin 9. The auxiliary yarn guide 6 shown in FIGS. 7 and 9 is provided with a vertical stem portion 6*f* and a horizontal guide portion 6*g* formed at a top end portion of the stem portion 6*f*. The bottom end of the stem portion 6*f* is turnably mounted on the horizontal supporting shaft 14 in such a condition that a free turning motion thereof is prevented by a stop means (not shown). As to this stop means, a mechanism provided with a compression spring and a stopper simiar to the mechanism utilized for the auxiliary yarn guide 6 shown in FIGS. 2, 3 and 4 can be applied. The horizontal guide portion 6*g* of the auxiliary yarn guide 6 is provided with a slighty curved guide edge P and a groove Q formed at a connecting portion of the horizontal yarn guide portion 6*g* to the stem portion 6*f*. During the normal winding operation, the auxiliary yarn guide 6 is positioned at its standby position represented by a solid line in FIG. 7. However, when it is required to form the transfer tail wind on a fresh bobbin 9 after completion of the doffing operation, the auxiliary yarn guide 6 is turned forward, that is, turned to a position represented by the dotted line in FIG. 7, and the yarn passage of the yarn 7 is displaced to the passage 7*a* from the normal passage represented by the solid line. According to the above-mentioned turning motion of the auxiliary yarn guide 6, the yarn 7 passes over the guide edge P of the horizontal portion 6g and the yarn passage 7a is displaced to a position defined by the groove Q due to a condition similar to the first embodiment shown in FIGS. 2, 3 and 4. Therefore, the transfer tail wind is formed on the bobbin 9 by a condition similar to the first embodiment of the present invention. After completion of the forming of the transfer tail end on the bobbin 9, the auxillary yarn guide 6 is turned to its standby position, and the yarn 7 is automatically caught by the groove of the split drum 8 so that the normal traverse motion of the yarn 7 is commenced.

Figure 8:
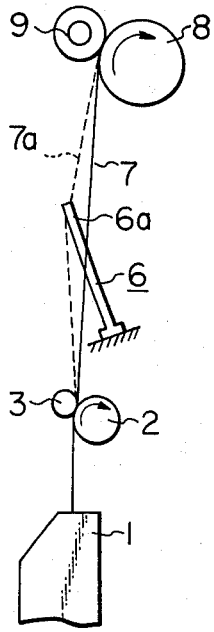
Figure 10:
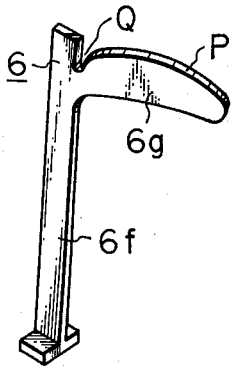

In the third embodiment of the transfer tail wind device shown in FIGS. 8 and 10, the auxiliary yarn guide 6 is stationarily disposed at a position similar to the auxiliary yarn guide 6 of the second embodiment shown in FIG. 7, instead of utilizing the turnable yarn guide. The construction of this stationary yarn guide 6 is almost the same as that of the turntable yarn guide 6 of the second embodiment shown in FIG. 7, except for the mounting condition thereof. Therefore identical reference numerals are used for elements which are identical to the second embodiment. In this embodiment, the position of the horizontal guide portion 6g is selected so as to be projected forward a little from the yarn passge represented by a solid line in FIG. 8. In the operation of this transfer tail forming device, the yarn passage is formed as shown by the solid line in FIG. 8 during the normal winding operation. However, when it is required to form the transfer tail wind on a fresh bobbin 9, the above-mentioned yarn passage is displaced to a passage 7a defined by the groove Q by manually moving the yarn 7 into the groove Q. During the time the yarn 7 is in the yarn passage 7a, the transfer tail wind is formed on the bobbin 9 by a condition similar to the first embodiment shown in FIGS. 2, 3 and 4. After completion of the forming of the transfer tail wind on the bobbin 9, the passage of the yarn 7 is displaced from the passage 7a to the normal passage represented by the solid line in FIG. 8, by manually taking the yarn 7 from the groove Q of the guide portion 6g. Thereafter the normal winding operation is carried out.

As mentioned above, the transfer tail wind forming device according to the present invention has a very simple construction and, therefore, the operation of this device can be carried out by only one operator simultaneously with the doffing and donning operation. According to our repeated mill tests, it was confirmed that the device of the present invention can be effectively utilized for very high speed winding operations, for all types of yarn, without any operational trouble such as creating snarls of yarn or winding the yarn around the top of the delivery roller means.

What is claimed is:

1. In a production unit of a ringless spinning machine provided with means for delivering a yarn from a spinning unit and a take-up mechanism for making a yarn package on a bobbin turnably held by said take-up mechanism, said take-up mechanism being provided with a traverse motion mechanism for forming said yarn package in cross winding by traversing said yarn, a device for forming a transfer-tail wind on said bobbin at a position outside said cross winding comprising an auxiliary yarn guide disposed at a position along a yarn passage formed between said delivery roller means and said traverse motion mechanism, said auxiliary yarn guide being provided with a smoothly formed yarn guide edge portion, a grooved portion formed at a position outside the terminal of said yarn guide edge portion, and a curved edge portion connecting said yarn guide edge portion to said grooved portion extending into the yarn guide edge portion traversed by said yarn during said traverse motion, said yarn guide edge portion positoned at a particular position wherein it is capable of engaging with said traversing yarn and said grooved portion being capable of taking a position outside the stroke of said traverse motion of said yarn along said yarn guide edge portion when said yarn is reciprocally traversed along said yarn guide edge portion, whereby when said yarn is urged to said yarn guide edge portion during said traverse motion thereof, said yarn is guided by said curved edge portion and displaced automatically to said grooved portion so that said yarn is forced to leave said traverse mechanism and stop the motion caused thereby, and is directed to an end portion outside the normal winding portion of said bobbin, and when said yarn is manually moved from said grooved portion of said auxiliary yarn guide, said yarn is caught by and resumes the motion caused by said traverse mechanism.

2. A device for forming a transfer-tail wind on a bobbin in a take-up mechanism of a production unit of a ringless spinning machine according to claim 1, wherein said delivery roller means is provided with a supporting shaft, and auxiliary yarn guide comprises a supporting bracket rigidly mounted on said supporting shaft and a yarn guide plate pivotably mounted on a top end portion of said supporting bracket, and means is provided for stably holding said yarn plate in either a vertical or horizontal position, said guide plate being provided with said smoothly formed yarn guide edge portion, and said grooved portion and said curved edge portion at the upper edge thereof.

3. A device for forming a transfer-tail wind on a bobbin in a take-up mechanism of a production unit of a ringless spinning machine according to claim 2, wherein said guide plate is held in a horizontal condition, the free end of said guide edge portion is positioned at a position slightly outside a terminal of the stroke of said traverse motion of said yarn and said grooved portion is positioned at a position slightly outside the other terminal of the stroke of the traverse motion of said yarn, and said curved edge portion is formed between a position slightly inside the latter of said terminals and said grooved portion, and the length of a yarn guide passage formed by said guide plate is large enough to prevent an unexpected escape of said yarn from said guide plate due to said traverse motion of said yarn.

4. A device for forming a transfer-tail wind on a bobbin in a take-up mechanism of a production unit of a ringless spinning machine according to claim 1, wherein said working unit is provided with a horizontal shaft parallel to a direction of said traverse motion of yarn, said auxiliary yarn guide comprises a vertical stem portion turnably mounted on said horizontal shaft, a horizontal yarn guide portion projected from a top end of said vertical stem portion toward a direction parallel to a direction of said traverse motion of yarn, said horizontal guide portion is provided with said yarn guide edge portion and said grooved portion formed at a top edge thereof, and means for selectively and stably holding the position of said horizontal guide portions at either one of two sides of a normal winding passage of said yarn.

5. A device for forming a transfer-tail wind on a bobbin in a take-up mechanism of a production unit of a ringless spinning machine according to claim 1, wherein said auxiliary yarn guide comprises a vertical stem portion and a horizontal yarn guide portion projected from a top end of said vertical stem portion toward a direction parallel to a direction of said traverse motion of said yarn, said stem portion being stationarily mounted on a body of said working unit in such a condition that said horizontal guide portion is positioned at a position slightly in front of said normal winding passage of said yarn, said horizontal guide portion being provided with said yarn guide edge portion, and said grooved portion and said curved edge portion formed at a top side edge thereof.

6. A device for forming a transfer-tail wind on a bobbin in a take-up mechanism of a production unit of a ringless spinning machine according to claim 1, wherein said auxiliary yarn guide is displaced between two working positions, which are situated midway between said take-up mechanism and said unit of the ringless spinning machine, one of said working positions being positioned in such a way that, after a full yarn package is replaced with a fresh bobbin, said auxiliary yarn is capable of engaging with said traversing yarn so that the transfer-tail wind is formed on the end of said fresh bobbin, and other of said working positions being positioned in such a way that, after completion of the forming said transfer-tail wind on said fresh bobbin, said auxiliary yarn guide is capable of disengaging from said traversing yarn so that the normal winding operation for forming the yarn package is commenced.

* * * * *

UNITED STATES PATENT OFFICE

CERTIFICATE OF CORRECTION

Patent No. 4,002,305 Dated January 11, 1977

Inventor(s) Tatsuo Takeuchi, et al.

It is certified that error appears in the above-identified patent and that said Letters Patent are hereby corrected as shown below:

Column 1, line 33: After "normal" insert --winding--.

line 35: Change "pickd" to --picked--.

Column 2, line 58: Change "Problem" to --problem--.

Column 3, line 61: Change "formed with the curved" to --formed and the curved--.

line 67: Change "show" to --shown--.

Column 5, line 55: After "top" insert --roller--.

UNITED STATES PATENT OFFICE

CERTIFICATE OF CORRECTION

Patent No. 4,002,305 Dated January 11, 1977

Inventor(s) Tatsuo Takeuchi, et al. Page 2 of 2

It is certified that error appears in the above-identified patent and that said Letters Patent are hereby corrected as shown below:

Column 6, line 5: After "said grooved portion" insert --said curved edge portion--.

line 29: Change "and" to --said--.

line 33: After "yarn" insert --guide--.

line 68: Change "portions" to --portion--.

Column 8, line 10: Change "yarn is" to --yarn guide is--.

Signed and Sealed this thirtieth Day of August 1977

[SEAL]

Attest:

RUTH C. MASON
Attesting Officer

C. MARSHALL DANN
Commissioner of Patents and Trademarks